US005356264A

United States Patent [19]

Watson et al.

[11] Patent Number: 5,356,264

[45] Date of Patent: Oct. 18, 1994

[54] VISCOELASTIC VIBRATION DAMPER FOR ENGINE STRUTS

[75] Inventors: Dennis W. Watson, West Chester; Michael T. Bonnoitt, Cincinnati, both of Ohio

[73] Assignee: General Electric Company, Cincinnati, Ohio

[21] Appl. No.: 136,508

[22] Filed: Oct. 14, 1993

Related U.S. Application Data

[63] Continuation-in-part of Ser. No. 813,547, Dec. 26, 1991.

[51] Int. Cl.[5] ..... F01D 5/10

[52] U.S. Cl. ..... 415/119; 416/500

[58] Field of Search ..... 415/119, 142; 416/140, 416/106, 500

[56] References Cited

U.S. PATENT DOCUMENTS

| | | | |
|---|---|---|---|
| 2,566,701 | 10/1951 | Griese | 416/140 |
| 2,690,810 | 10/1954 | Doussain et al. | 416/500 |
| 2,917,274 | 12/1959 | Davidson | 253/77 |
| 3,027,138 | 3/1962 | Howell et al. | 253/77 |
| 3,791,483 | 2/1974 | Vasiljevic | 415/119 |
| 3,966,357 | 6/1976 | Corsmeier | 416/500 |
| 4,240,250 | 12/1980 | Harris | 415/119 |
| 4,329,119 | 5/1982 | Baskin | 416/500 |
| 4,820,117 | 4/1989 | Larrabee et al. | 415/142 |
| 5,056,738 | 10/1991 | Mercer et al. | 415/119 |
| 5,284,011 | 2/1994 | Von Benken | 415/119 |

FOREIGN PATENT DOCUMENTS

| | | | |
|---|---|---|---|
| 0535074 | 12/1956 | Canada | 416/500 |
| 0891635 | 3/1944 | France | 416/500 |
| 1326783 | 7/1987 | U.S.S.R. | 415/119 |

OTHER PUBLICATIONS

U.S. Patent Appln S/N 06/317,356, filed Nov. 2, 1981, by Vdoviak, et al. "Variable Slot Bypass Injector System".

*Primary Examiner*—Edward K. Look
*Assistant Examiner*—Mark Sgantzos
*Attorney, Agent, or Firm*—David L. Narciso; Jerome C. Squillaro

[57] ABSTRACT

The present invention is a viscoelastic damper assembly for a front frame for a gas turbine engine that is removable, reusable, and retrofitable. The viscoelastic damper is disposed within a strut for damping vibration of the strut caused by airstream pressure pulses from first stage fan blades operating at transonic speeds. The viscoelastic damper can be installed in struts on gas turbine engines already in service or during manufacture. Also, the viscoelastic damper can be easily removed and reused when repairs to the front frame are required.

20 Claims, 6 Drawing Sheets

VISCOELASTIC VIBRATION DAMPER FOR ENGINE STRUTS

The government has rights in the invention pursuant to Contract No. F33657-84C-2011 awarded by United States Department of the Air Force.

This application is filed as a continuation-in-part application of U.S. Ser. No. 07/813,547 for a Viscoelastic Damper for Engine Struts, filed on Dec. 26, 1991.

BACKGROUND OF THE INVENTION

The present invention relates generally to a damper for a hollow strut in a gas turbine engine, and more particularly to a damper assembly for a strut in a gas turbine engine that is removable and retrofitable.

DESCRIPTION OF THE PRIOR ART

Gas turbine engines include a family of engines known as transonic gas turbine engines. These transonic engines may be of a turbofan type capable of operating at transonic or supersonic speeds. The transonic engines typically include a front frame, the upstream end of which forms an inlet sized to provide a pre-determined air flow, and a fan directly behind the front frame for pressurizing the inlet airflow. Downstream of the fan is a core engine for combusting fuel mixed with the pressurized air to produce combustion gases which are discharged to obtain a propulsive force for the engine.

The front frame typically includes a cast outer cylindrical case or shroud, an inner circumferential support or hub ring, and a plurality of circumferentially spaced apart and radially outwardly extending fixed struts disposed between the outer cylindrical case and the inner circumferential hub ring. An internal strut stiffener is generally disposed between the walls of the strut to resist buckling of the strut walls. The fan typically includes a fan rotor which rotates a plurality of blade assemblies in at least one or more rows or stages. During assembly or operation of the fan, physical variations may exist in or between the blade assemblies. For example, circumferential variation may exist in the spacing of the blade assemblies about the rotor. Further, the leading edges of the blade assembly can become nicked or blunted. When the fan blades are operated at transonic or supersonic speed, physical variations in the first stage blade assemblies of the fan will produce airstream pressure pulses or fluctuations known as "multiple pure tones." These multiple pure tones travel forward and excite the strut to vibrate at its natural frequencies. This pure tone excitation occurs over a broad range of frequencies. In normal operation, the vibrations can cause strut cracking due to high cycle fatigue and damage can also result from debris that gets ingested into the front end of the engine, sometimes known as Foreign Object Debris (FOD), both strut cracking and debris damage both require repair of the front frame. It is desirable to eliminate or reduce the strut vibrations and to facilitate any repair that may be required due to high cycle fatigue cracks. The front frame is comprised of struts which are an expensive engine component to replace. Further, a repair to any element of the front frame that requires either brazing or welding, is equally expensive because the whole front frame is subjected to a heat treat process to eliminate localized stresses that could be initiation sites for subsequent cracks.

To avoid these problems, it is a common practice to dampen the strut vibrations excited by the multiple pure tones. Vibration damping is usually accomplished by either friction damping (often called coulomb damping), by constrained layered damping, or by silicone rubber injection damping. Each method is effective, but has its limitations.

Friction dampers are effective in reducing resonant stresses in aircraft structures through microscopic slips on interfaces where machine elements are joined in a press fit. The efficiency of a friction damper is dependent on the matched contact pressure of the damper parts. Friction dampers are susceptible to part wear that degrades the optimum pressure and, therefore, the effectiveness of the friction damper. Friction dampers also are labor intensive because they require optimum sizing during manufacture and during retrofit, both of which require many friction damper sizes which generates a high cost.

Constrained layered damping sandwiches viscoelastic material between thin layers of metal and bonds it to the exterior surface of a strut. Vibration energy can be dissipated in the viscoelastic layers. While the constrained layered damper can act as an insulator and inhibit anti-icing of the strut, it is vulnerable to damage by foreign object debris (FOD), and decreases inlet airflow by adding of thickness to the struts. Further, constrained layer damping is labor intensive to apply and repair. A viscoelastic material, as used herein, is a name given to a class of materials that displays a stretching or elongation response usually referred to as a strain to an external stress that is dependent on the initial stress, on the strain, and on either the time rate of application of the stress or the time rate of change of the strain. These materials usually exhibit a time lag in the strain relative to the stress and usually exhibit creep under a constant applied stress. For example, some typical viscoelastic materials usable in constrained layer damping include RTV materials such as silicone rubber manufactured by various companies and Kalrez manufactured by the Dupont Chemical Company.

Silicone rubber injection damping is a form of viscoelastic damping that has good damping characteristics and overcomes some of the limitations of some of the other damping methodologies, however, there are still drawbacks to its use in struts on aircraft engines. During installation, viscoelastic material is injected into a strut cavity and cured. Once there, the viscoelastic material becomes an integral part of the strut. During any repair operation, additional time is required to remove the viscoelastic material from all the struts, including those that were not repaired. If a strut has to be brazed or welded the entire front frame must be heat treated at a temperature that would cause any viscoelastic material in the strut to melt/burn and clog up the strut interior. If the strut requires de-icing, or anti-icing as it is sometimes called, viscoelastic material residue left in any of the struts in the front frame during heat treating can inhibit anti-icing airflow in the strut.

SUMMARY OF THE INVENTION

In carrying out one form of this invention, a viscoelastic vibration damper is provided for a strut in a gas turbine engine which includes a pair of spaced walls extending radially between an outer cylindrical case and an inner circumferential hub ring and axially between a leading edge and a trailing edge and a strut stiffener disposed between the strut walls and forming a plurality of cells that extend approximately the length of the strut and which have viscoelastic material disposed in at least one strut cell, wherein the viscoelastic material is in contact with the pair of spaced walls. The viscoelastic material can be inserted into at least one of the strut cells through an access hole in the outer case. Viscoelastic material may be inserted into more than one strut cell, however, only a minimal increase in damping effectiveness is realized by adding viscoelastic damping to additional strut cells. Viscoelastic material, which is normally very pliable, becomes insertable into a cell when it is applied to a stiffening means. A threaded damper plug is installed in the access hole and acts to insure a proper seating of the viscoelastic damper in the strut cell when the damper plug engages an end of the stiffening means and a pre-determined torque is applied to the damper plug. Pre-determined torque is chosen to ensure contact between the viscoelastic material and the strut walls along the entire length of the viscoelastic damper. In a preferred embodiment, it is desirous to be able to install a viscoelastic damper on new or existing jet engine struts and to be able to remove the viscoelastic damper for subsequent repair. The struts are usually tapered from the strut end containing the access hole, located on the outer case, to the strut end connected to the hub ring. The viscoelastic damper comprises two strips of viscoelastic material bonded to a thin strip of metal. The two strips of viscoelastic material can be of equal thickness and shaped to conform to and contact the tapered strut walls and to maintain a clearance area between the viscoelastic material and the adjacent cell walls. The thin metal strip has a loop in one end and forms a backbone for the viscoelastic material and adds sufficient stiffness to the viscoelastic material to assist in the insertion and removal of the viscoelastic damper into and from the strut cell. The loop is shaped to provide a grip for removal and to provide a bearing surface for the damper plug that ensures that the viscoelastic damper is in contact with the strut walls during operation. Several holes can be machined through the viscoelastic material to permit anti-icing air to circulate through the cells of the strut if needed for a specific engine application.

Accordingly, the present invention produces sufficient damping to dissipate energy caused by multiple pure tone strut excitation. The present invention provides viscoelastic damping of the strut to dissipate energy and reduce strut cracking.

Further, the present invention provides a damper assembly that can be easily removed while repairs and heat treating of the strut are made and then replaced while maintaining its damping ability. The ability to reinstall the damper without loss of function is important to the engine owner because it reduces repair costs and downtime for the engine.

Still further, the present invention can be installed in existing engines in the field. The damper assembly can be tailored to several gas turbine engine strut designs.

Still further, the present invention increases damping of the strut for the first and second flexural and torsional natural frequencies, and for higher order mode shapes present in an engine operating environment.

Still further, the present invention provides a damper that performs its damping function while permitting anti-icing air to circulate through the strut.

Other features and advantages of the present invention will be readily appreciated as the same becomes better understood by reference to the following description when considered in conjunction with the accompanying drawings.

BRIEF DESCRIPTION OF THE DRAWINGS

The present invention is illustrated by way of detailed example in the Figures of the accompanying drawing in which like reference numerals refer to like elements throughout, and in which.

Figure 7:
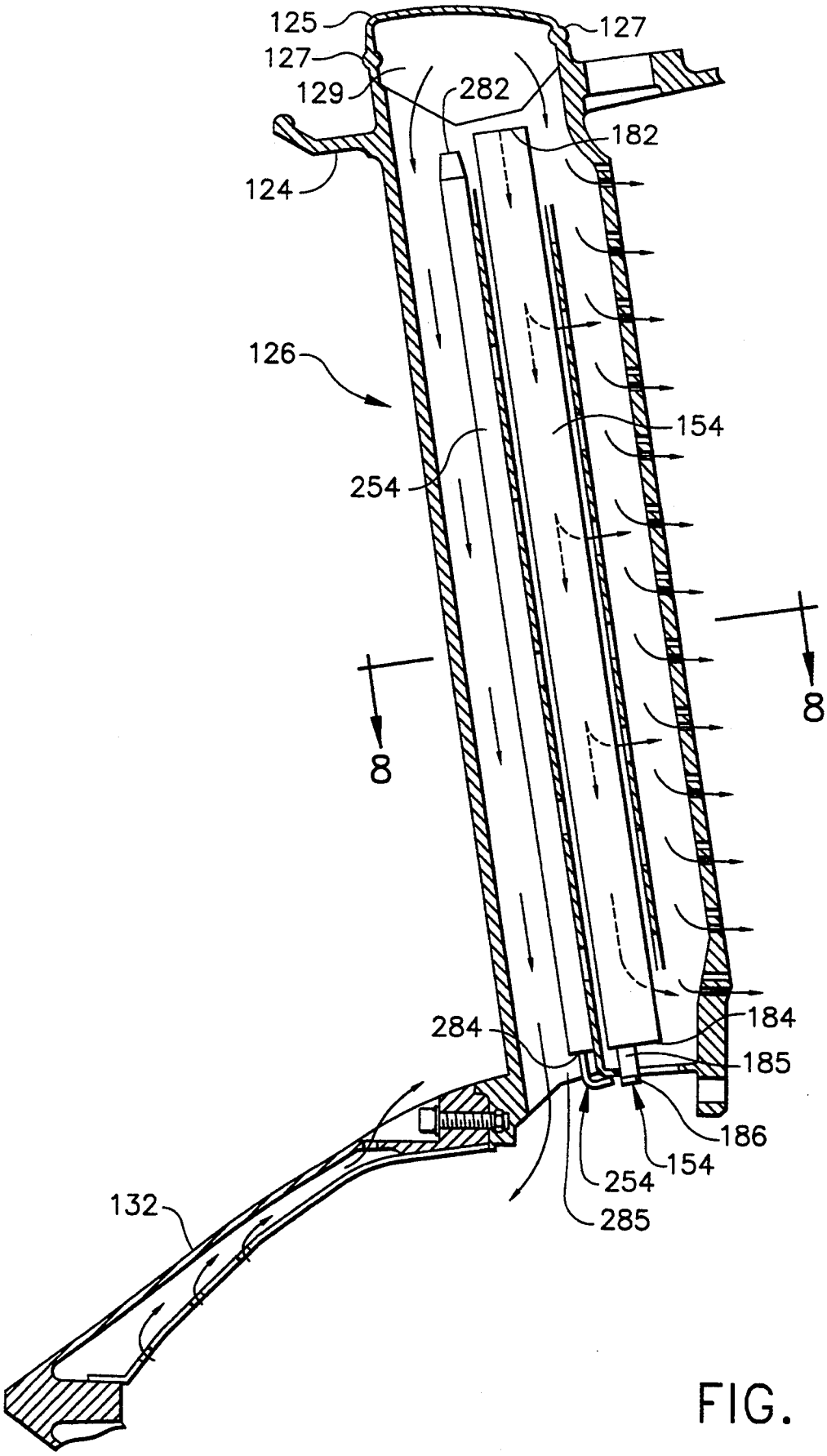
FIG. 7 is an illustration of a cross-sectional view of a strut along the engine axis according to an alternate embodiment of the present invention.
Figure 7A:
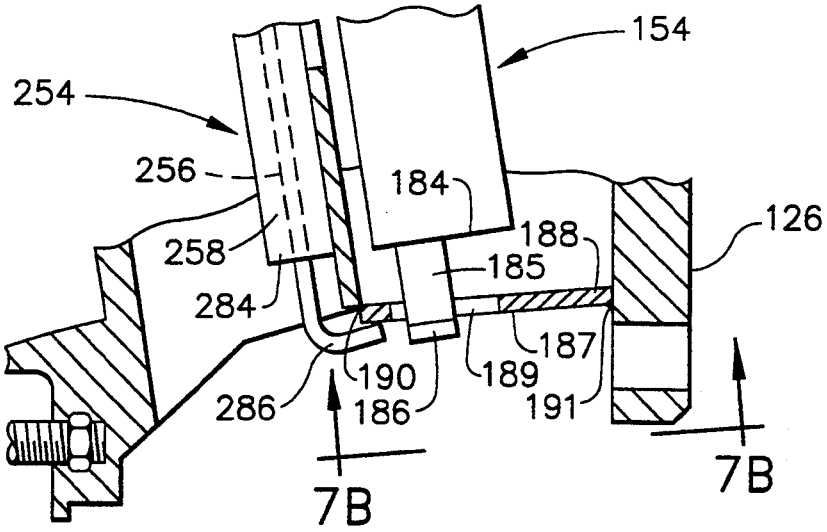
Figure 7B:
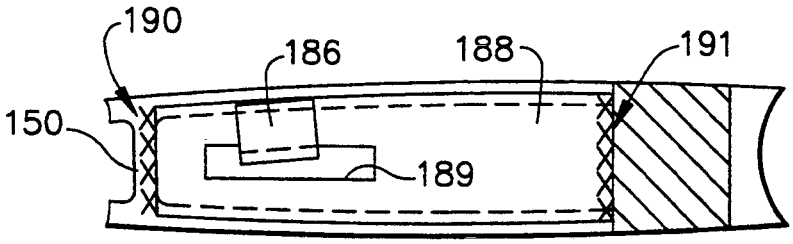

FIG. *7a* is an enlarged partial cross-sectional view of the radially inner end of the strut of FIG. 7.

FIG. *7b* is a plan view looking radially outward along lines *7b—7b* of FIG. *7a*.

Figure 8:
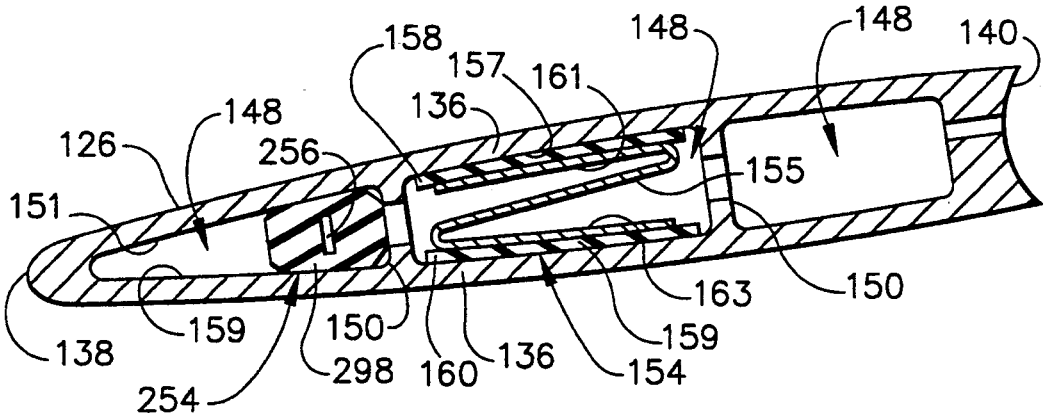

FIG. 8 is an illustration of a cross section of the strut of FIG. 7 along lines 8—8 of FIG. 7.

DESCRIPTION OF THE PREFERRED EMBODIMENT

Figure 1:
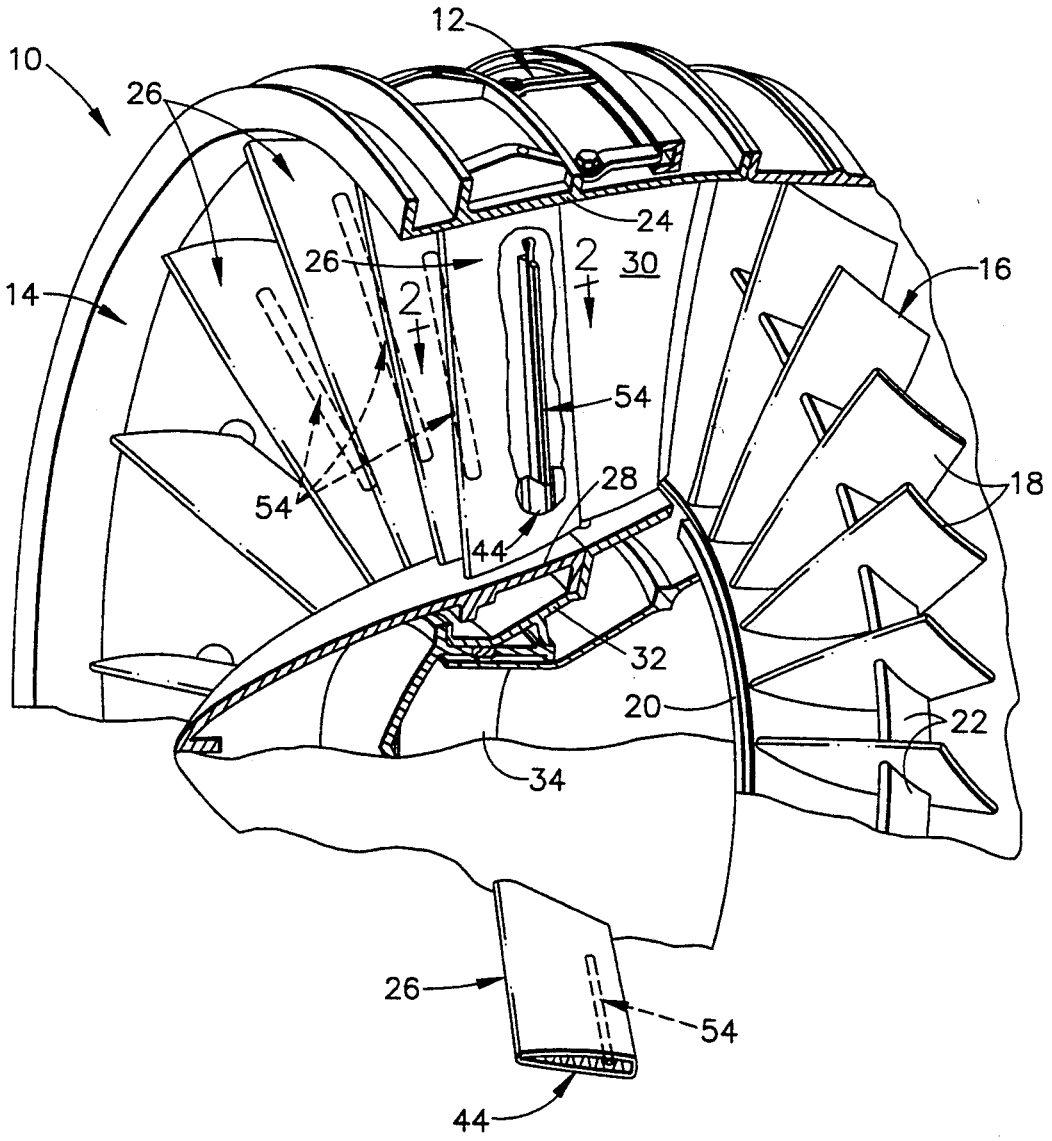
FIG. 1 is an illustration of a partial perspective view of a front frame and fan of a gas turbine engine having struts incorporating a damper assembly according to the present invention.

Referring now to the drawings, wherein like numerals correspond to like elements throughout, attention is first directed to FIG. 1. In FIG. 1, a portion of gas turbine engine 10, such as a turbofan gas turbine engine is shown. It should be appreciated that the gas turbine engine 10 includes fan blades, generally shown at 16, which may be of a suitable type capable of operating at transonic or supersonic speeds.

The jet propulsion engine 10 includes a front frame, generally indicated at 12, the upstream end of which forms an inlet 14 sized to provide a predetermined inlet airflow. The jet propulsion engine 10 includes a fan 16 downstream of the front frame 12. The fan 16 pressurizes the airflow from the inlet 14 at least a portion of which is delivered downstream to a core engine (not shown) where the pressurized air is heated in a combustor. After passing through the core engine, the pressurized and heated air flows through and turns a fan turbine (not shown) which inter connects the fan 16 by means such as a shaft (not shown). The core engine typically includes an axial flow compressor (not shown) which compresses or pressurizes the air exiting the fan which is then discharged to a combustor (not shown). In the combustor, fuel is burned to provide high energy combustion gases which drive a high pressure turbine which, in turn, drives the compressor. The combustion gases then pass through and drive the fan turbine which in turn drives the fan. A more detailed description of an exemplary gas turbine engine 10 is disclosed in U.S. Pat.

No. 3,879,941 Sargisson or U.S. Pat. No. 4,080,785 Koff et al, both of which are assigned to the same assignee as the present invention, and the disclosed material of both patents is incorporated herein by reference.

The fan 16 includes a first or forward fan stage including a plurality of rotor blade assemblies 18 which are circumferentially spaced apart about a fan rotor 20. Each forward rotor blade assembly 18 includes a part-span shroud 22 extending beyond the full chord of the blade and in an abutting relation with a part span shroud 22 of adjacent blade assemblies 18. It should be appreciated that the fan 16 may include a plurality of rows or stages of rotor blade assembly 18.

The front frame 12 is positioned directly in front or upstream of the fan rotor 20. The front frame 12 includes a cast outer cylindrical case or shroud 24 which forms the inlet 14. The front frame 12 includes a plurality of circumferentially spaced apart struts generally indicated at 26, extending radially outward from an inner circumferential support or hub ring 28 to the outer cylindrical case 24. Each strut 26 may include a variable angle trailing edge flap or inlet guide vane (IGV) 30 positioned directly behind or downstream of each strut 26. The inner circumferential hub ring 28 includes inwardly and forwardly extending conical extension 32 for supporting forward fan shaft bearing 34. It should be appreciated that the struts 26 are fixedly connected to the outer cylindrical case 24 and inner circumferential hub ring 28.

Figure 2:
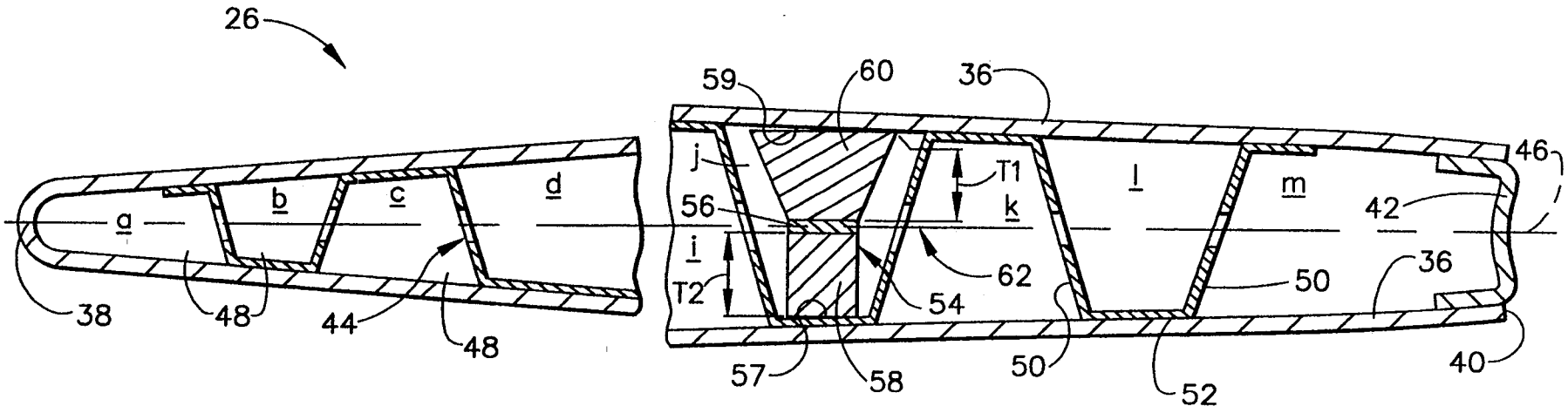
FIG. 2 is an illustration of a cross-sectional view of the damper assembly installed in the strut taken along line 2—2 of FIG. 1.

Referring to FIGS. 1 and 2, the strut 26 includes a pair of strut walls 36 which extend from a generally arcuate leading edge 38 to an open trailing edge 40. The strut 26 includes a generally U-shaped end support member 42 disposed between the strut walls 36 to close the strut trailing edge 40. The support member 42 can be secured to the strut walls 36 typically by brazing. An internal strut stiffener 44 is disposed between the strut walls 36 from the leading edge 38 to the trailing edge 40 of the strut 26 and extends radially along the strut walls 36. The internal strut stiffener 44 can be corrugated and preferably have a shape similar to a honeycomb or square wave. The internal strut stiffener 44 extends along a neutral axis 46 of the strut 26 extending between the leading and trailing edges 38 and 40, respectively. The internal strut stiffener 44 divides the hollow interior of the strut 26 into a plurality of cells collectively shown as 48. As shown in FIG. 2, each cell 48 is indicated by an additional reference letter, beginning with the cell 48 labeled "a" near the leading edge 38 and consecutively lettered for thirteen cells which end near the trailing edge 40. Each cell 48 of the internal strut stiffener 44 is formed by generally inclined vertical walls 50 on each end of the horizontal wall 52. The horizontal wall 52 is shaped to follow the contour of the inside surface of the strut walls 36 and is secured to the strut walls 36 by means such as brazing.

Referring again to FIGS. 1 and 2, a strut 26 incorporating a damper assembly 54 according to the present invention is shown. Damper assembly 54 includes a thin metal strip, or ribbon of metal, 56 bonded to first and second viscoelastic pieces, 58 and 60 respectively. First viscoelastic piece 58 has a rectangular cross section and the second viscoelastic piece 60 has a trapezoidal shaped cross section. The entire viscoelastic damper assembly 54 is shaped to generally conform to the cross-sectional shape of the cell j as shown in FIG. 2. The first viscoelastic member 58 has a thickness T2 and the second viscoelastic member has a thickness T1. It is intended that T1 and T2 are approximately equal for best performance, however, significant variations in these dimensions can occur without departing from the scope of this invention.

Best performance of the viscoelastic damper 54 is achieved when a ratio of T1 over T2 is between is between $\frac{1}{2}$ and 2. Proper operation of the viscoelastic damper is achieved when the first viscoelastic member 58 and the second viscoelastic member 60 remain in contact with the interior surfaces 57 and 59, respectively, of the strut walls 36. Stiffener 56 is usually made of metal but can be made of other suitable materials. When made of stainless steel, an appropriate dimension is 0.025 inch thick; or when made of some other material, a thickness that has equivalent stiffness. As shown in FIGS. 1 and 2, the damper assembly 54 is disposed in the strut 26 in the cell 48 having a reference letter j. The damper assembly 54 extends radially along the struts 26 and is oriented such that the geometric center 62 of the damper assembly 54 approximately coincides with neutral axis 46 of the strut 26. It is preferred that one or more damper assemblies 54 can be disposed near the center of the strut in an area of large deflection of the strut walls 36 and may extend only partially radially along the length of the strut 26. It should also be appreciated that the damper assembly 54 may be located in a cell 48 having a different reference letter. It should further be appreciated that more than one damper assembly 54 may be used. It should still further be appreciated that the damper assembly 54 may be used with any suitable strut stiffener 44.

Figure 3:
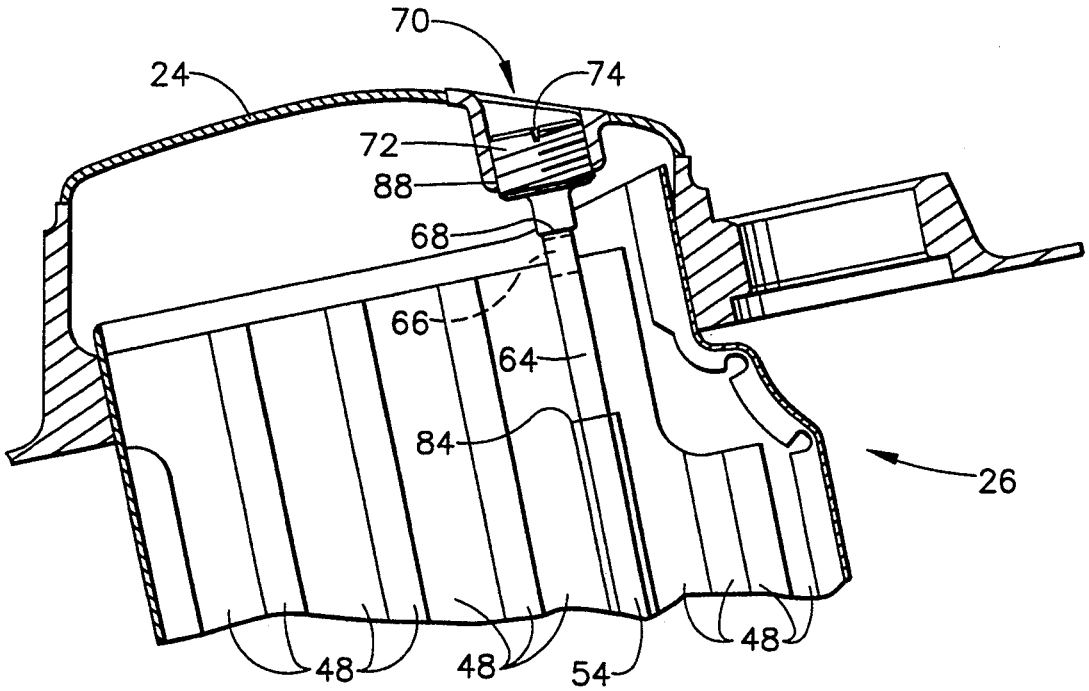
FIG. 3 is an illustration of a partial cross-sectional view of a strut according to the present invention detailing a damper plug installed in an access hole and interfaced with the viscoelastic damper assembly.

Referring now to FIG. 3 wherein a partial cross section of a strut 26 is shown, wherein an installation of the viscoelastic damper assembly 54 can be appreciated. Viscoelastic damper assembly 54 is inserted into strut 26 through an access hole 70 and is pushed into cell 48 until the full length of damper assembly 54 is in contact with first and second interior surfaces 57 and 59, respectively. A damper plug 72 can be thread seated within hole 70 and can be advanced into access hole 70 until it engages loop end 68 establishing a compression fit of the viscoelastic damper assembly 54 within the cells 48 and against the cell walls 57 and 59.

A predetermined torque is applied to damper plug 72 via a tool engaging tool slot 74 to ensure a proper seating of viscoelastic damper assembly 54 in cell 48. Proper seating of viscoelastic damper assembly 54 is accomplished when the surfaces of the viscoelastic material are in contact with the interior surfaces 57 and 59 of strut wall 36 as shown in FIGS. 1 and 2.

Figure 4:
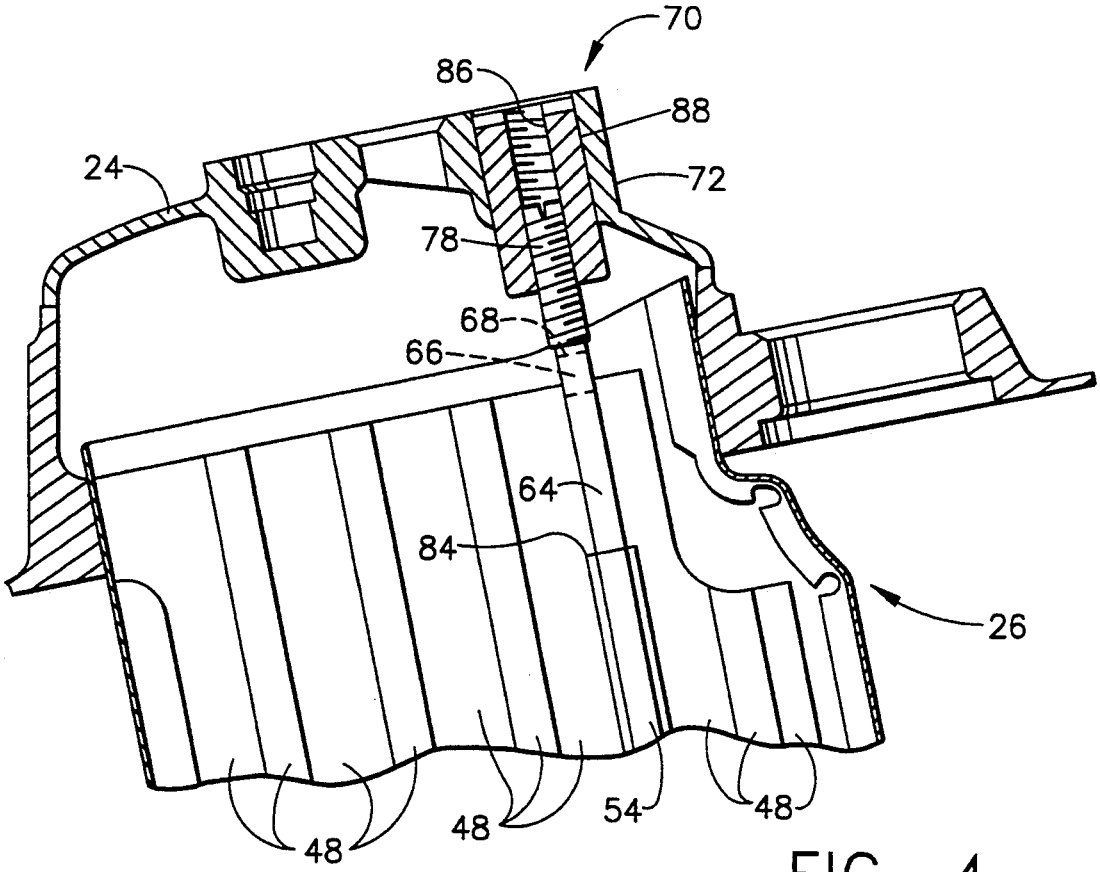
FIG. 4 is an illustration of a partial cross-sectional view of a strut showing an alternate embodiment of a damper plug installed in an access hole and interfacing with the damper assembly.

FIG. 4 depicts a partial cross section of strut 26 incorporating an alternate embodiment of damper plug 72 wherein the damper plug 72 has a threaded plug hole 86 through the center of plug 72. Plug screw 78 is advanced through plug hole 86 until it engages loop end 68 of viscoelastic damper assembly 54. As described in FIG. 3, plug screw 78 is advanced until a pre-determined torque ensures that the viscoelastic damper assembly 54 is properly seated in cell 48.

Figure 5:
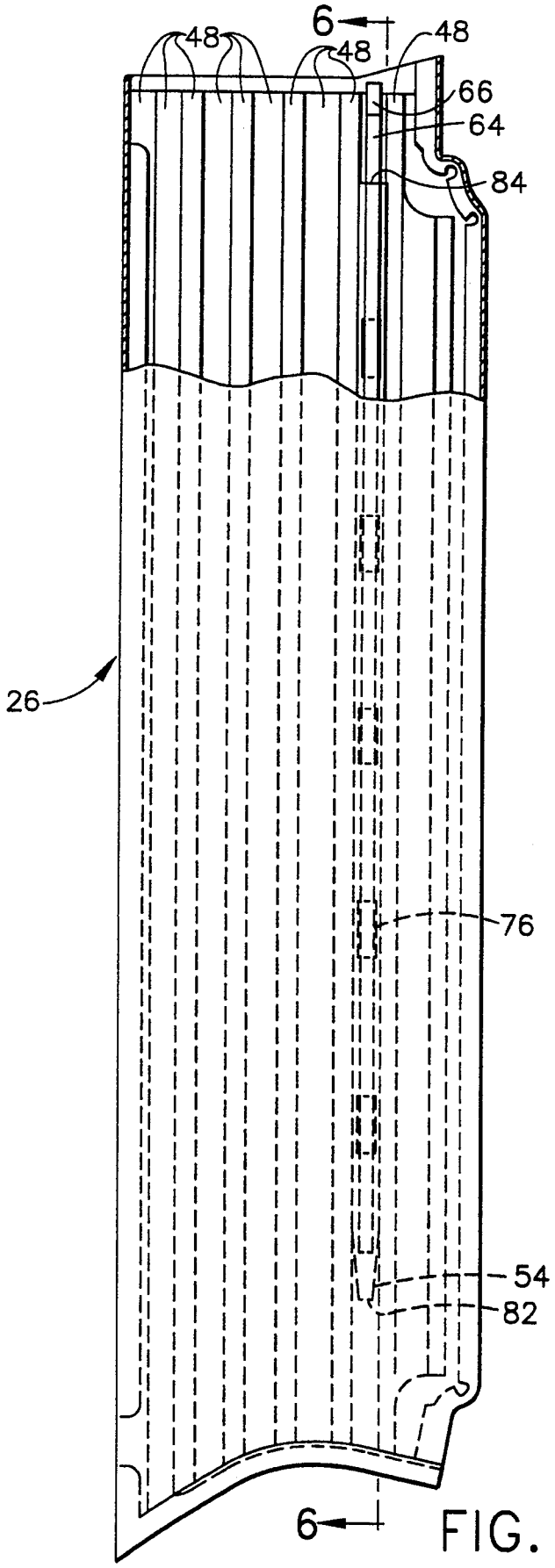
FIG. 5 is an illustration of a cross section of a strut for a gas turbine engine showing the plurality of cells and the strut with the viscoelastic damper installed.

FIG. 5 is a cross-section of strut 26 showing the various cells with a viscoelastic damper assembly 54 installed. Upon installation of viscoelastic damper assembly 54, first damper end 82 is advanced into cell 48 until loop 66 can no longer be advanced by hand. Shown in detail is the structure of viscoelastic damper assembly 54. Ribbon of metal type stiffener 64 has a first, or insertion, end 90 and a second, or loop, end 68. First end 82 of viscoelastic material extends beyond the insertion end 90 of stiffener 64 and does not cover the entire length of stiffener 64, but stops at second end 84 of viscoelastic material before it reaches loop 66. Anti-icing vents 76 can be distributed along the length of damper assembly 54 in accordance with the anti-icing requirements of strut 26. In some small fan embodiments, one anti-icing vent 76 can be sufficient or alternatively several can be included as shown in FIG. 5.

Figure 6:
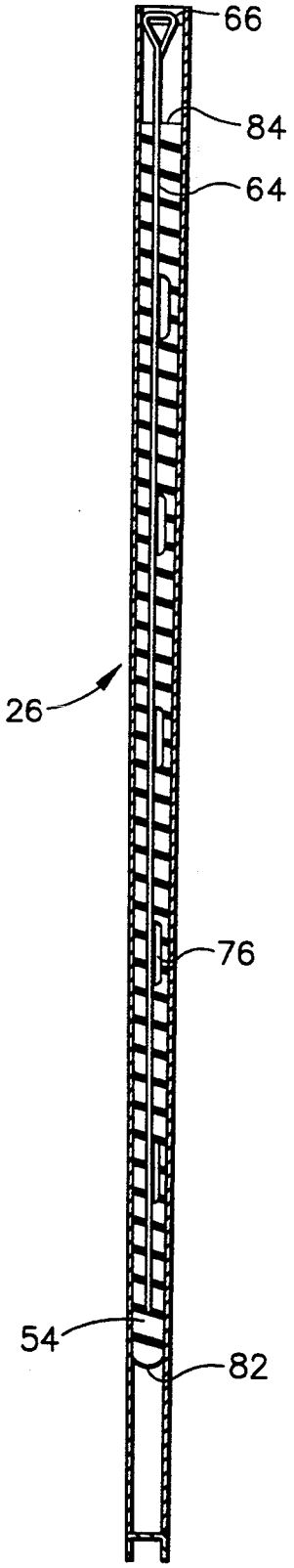
FIG. 6 is an illustration of a cross section of a damper taken along lines 6—6 of FIG. 5 showing the details of the viscoelastic damper assembly.

Referring now to FIG. 6, there is shown a cross section of a strut taken along section 6—6 from FIG. 5 and is a cross-sectional view of an installed viscoelastic damper 54. First damper end 82 is inserted nearly the entire length of strut 26. Stifleher 64 is located through the approximate center of the viscoelastic damper assembly 54. One or more anti-icing vents 76 are machined transversely through the viscoelastic damper assembly 54 to permit anti-icing air to circulate throughout the strut 26. Stiffener 64 has a loop 66 formed in the second end of viscoelastic damper assembly 54 to facilitate removal and to act as an installation pressure point as discussed previously.

Referring now to FIG. 7, there is shown an illustration of a cross section of a forward engine strut showing an alternate embodiment of the viscoelastic damper assembly in a different strut configuration. Strut 126 is depicted as extending radially outward from nose cone 132 to an outer cylindrical shroud 124. The strut 126 is attached to the inner circumferential support or hub ring, not shown, by conventional means. In this embodiment, the circumferentially adjacent multiple struts 126 are cast and machined as one piece including the outer cylindrical shroud 124. Cap 125 is then welded to the casting at weld lines 127 to form a manifold 129 for supplying anti-icing airflow to struts 126.

Referring now to FIG. 8, strut 126 includes a pair of strut walls 136 extending from a generally arcuate leading edge 138 to a trailing edge 140, which in this strut embodiment is closed, and includes internal strut stiffening walls 150 and 151, defining a plurality of cells 148, three in this embodiment. As shown in FIGS. 7 and 8, the strut 126 includes two viscoelastic damper assemblies 154 and 254. Viscoelastic damper assembly 154 comprises an elastic frame 155, such as the Z-spring depicted, including legs 161 and 163, with first viscoelastic member 158 and second viscoelastic member 160 bonded thereto on the outward facing surfaces of legs 161 and 163, respectively. The legs 161 and 163 serve to stiffen the viscoelastic members as did the stiffeners of the prior embodiments, while the elastic frame 155 serves to bias the legs away from each other such that the viscoelastic material is in contact with the interior surfaces 157 and 159 of the space strut walls 136. As shown in FIG. 8, the viscoelastic members 158 and 160 extend beyond the ends of legs 161 and 163, preventing the legs from damaging the vertical walls 150, 151 especially during installation and removal. By including an elastic frame 155, with biasing means to force legs 161 and 163 outward, in the viscoelastic damper assembly 154, the assembly can accommodate a wide range of strut widths such that controlling the tolerance of the width of the damper is not as necessary, the biasing or spring force engaging the viscoelastic material with the interior surfaces of the strut over a wide range of widths.

Referring again to FIGS. 7 and *7a*, viscoelastic damper assembly 154 is shown as having a first end 182 and a second end 184. Means for installation and removal of damper assembly 154 include an installation finger 185 extending from second end 184. Tab 186 extends from the installation finger 185 in a plane transverse the radial direction of the installation finger 185 and remainder of the damper assembly 154. Viscoelastic damper assembly 154 is installed by forcing legs 161 and 163 towards each other, then inserting first end 182 into the middle cell from the inner end 187 of strut 126, and pushing damper assembly 154 radially outward. FIG. *7b* is a plan view looking radially outward along lines *7b—7b* of FIG. *7a*, but with tab 286 and damper 254 removed for clarity. Referring to FIGS. *7a* and *7b*, tab 186 is inserted through slot 189 in metering plate 188 such that plate 188 prevents overinsertion of damper assembly 154 into strut 126. Plate 188 is tack welded to the base of strut 126. Tack weld 190 at the inner end of stiffening wall 150 and tack weld 191 at the trailing edge wall of strut 126 prevent movement of damper assembly 154 into strut 126 during engine operation. Metering plate 188 also serves to control anti-icing airflow through the strut during engine operation, as shown in FIG. 7. Insertion of viscoelastic damper assembly 154 is facilitated by coating first and second viscoelastic members 158 and 160, respectively, with a soft petroleum assembly grease, such as according to Federal Specification VV-P-236, prior to insertion. The petroleum base quickly evaporates during early use of the engine such that the damper will perform as desired during transonic operation. Strut 126 also includes a viscoelastic damper assembly 254 which includes a thin metal strip 256 surrounded by viscoelastic material 258. Viscoelastic damper assembly 254 also includes a first or insertion end 282 and a second end 284 with a means for inserting and removing the viscoelastic material into the strut 285 comprising a tab 286 tack weldcot to metering plate 188.

In operation, multiple pure tones may be produced as described above, for instance, by physical variations in the first stage blade assembly 18, as shown in FIG. 1 when the fan blades are operating at transonic or supersonic speeds. Multiple pure tones travel forward to excite or vibrate the struts 26. This produces bending or flexural and/or torsional movement of the strut walls 36. Viscoelastic damper assemblies 54, 154, and 254 flex as a result of the movement but the movement lags behind the flexing stress. As a result, the viscoelastic damper assemblies 54, 154, and 254 absorb and dissipate the energy caused by strut excitation.

Accordingly, the viscoelastic damper assembly 54, as shown in FIGS. 1 through 6, and viscoelastic damper assemblies 154 and 254, as shown in FIGS. 7 and 8, dissipate the energy at the interface of the respective viscoelastic damper assembly 54, 154, and 254 with strut walls 36 and 136. The viscoelastic damper assemblies described significantly increase the damping of the respective struts 26 and 126 for substantially all modes of excitation and substantially all multiple pure tone frequencies.

Further, the viscoelastic damper assemblies 54, 154, and 254 can be easily removed while repairs and heat treating of the respective strut are made and then replaced while maintaining its damping ability. The ability to re-install the viscoelastic damper assemblies 54, 154, and 254 without loss of function is important to the engine 10 owner because it reduces repair costs and downtime for the engine 10.

The present invention has been described in an illustrated manner. It is to be understood that the terminology which has been used is intended to be in the nature of words of description rather than of limitation. Many modifications and variations of the present invention are possible in light of the above teachings. For example, the present invention can be applied to any static, hollow airfoil, which includes struts or vanes, that is upstream of a rotating blade. One such embodiment may be a hollow guide vane in front of an aft mounted fan, another is a hollow vane in front of a compressor blade. It is, therefore, to be understood that within the scope of the appended claims, the present invention may be practiced otherwise and as specifically described.

We claim:

1. A damper assembly for use on a strut in a gas turbine engine, said strut including a pair of spaced walls extending radially between an outer cylindrical case and an inner circumferential hub ring and axially between a leading edge and a trailing edge and a strut stiffener disposed inside said strut between said walls and forming a plurality of cells, said damper assembly comprising:

a) viscoelastic material disposed within at least one of said cells, such that said viscoelastic material is in contact with said pair of spaced walls; and b) means for inserting said viscoelastic material into said strut cell and removing said viscoelastic material from said strut cell coupled to said viscoelastic material;

c) wherein said means for inserting and removing said viscoelastic material maintains a damping ability of said damper assembly during removal of said viscoelastic material from said strut cell.

2. A damper assembly as recited in claim 1 wherein said viscoelastic material is configured for installation in a cell between said walls, and said means for inserting and removing said viscoelastic material comprises means for stiffening said viscoelastic material.

3. A damper assembly as recited in claim 2 wherein said stiffening means comprises a ribbon of metal having a first end and a second end.

4. A damper assembly as recited in claim 3 wherein;

a) said ribbon of metal second end includes means for grasping said damper assembly;

b) said damper assembly further comprises a damper plug which is thread seated within an access hole of said strut, said damper plug engaging said means for grasping so as to establish a compression fit of said viscoelastic material against said pair of spaced walls.

5. A damper assembly as recited in claim 3 wherein said viscoelastic material covers said ribbon of metal first end.

6. A damper assembly as recited in claim 4 wherein said grasping means comprises a loop formed in said second end of said ribbon of metal.

7. A damper assembly as recited in claim 1 further comprising means for circulating anti-icing air through said damper assembly.

8. A damper assembly as recited in claim 7 wherein said circulating means comprises at least one passage extending transversely through said damper assembly thereby providing flow communication between said strut cells.

9. A damper assembly for use in a strut of a gas turbine engine, said strut including a pair of spaced walls extending radially between an outer cylindrical case and an inner circumferential hub ring and axially between a leading edge and a trailing edge and a strut stiffener disposed between said walls and forming a plurality of cells, said damper assembly comprising:

viscoelastic material bonded to means for stiffening said viscoelastic material and disposed within at least one of said strut cells such that said viscoelastic material contacts said pair of spaced walls;

means for removing said viscoelastic material while maintaining a damping ability of said damper assembly thereby making said strut repairable and capable of being heat treated at an elevated temperature when said viscoelastic material is removed and thereby permitting said damper assembly to be re-installed within said strut cell after said strut is repaired; and means for circulating anti-icing air through said damper assembly.

10. A damper assembly as recited in claim 9, wherein said stiffening means comprises a ribbon of metal having a first end and a second end.

11. A damper assembly as recited in claim 9, wherein;

said removing means comprises bonding said viscoelastic material bonded to a ribbon of metal having a first end and a second end and having a loop formed in said second end; and said damper assembly further comprises a damper plug which is thread seated within an access hole of said strut, said damper plug engaging said loop so as to establish a compression fit of said viscoelastic material against said pair of spaced walls.

12. A damper assembly as recited in claim 9, wherein said circulating means comprises at least one passage extending transversely through said damper assembly.

13. A damper assembly for use on a strut in a gas turbine engine, said strut including a pair of radially extending spaced walls with facing surfaces, said damper assembly comprising:

a) an elastic frame including a pair of radially extending legs, each leg having an outward facing surface;

b) viscoelastic material bonded to said outward facing surfaces of said legs;

c) said elastic frame biasing said legs away from each other such that said viscoelastic material is in contact with said spaced walls.

14. A damper assembly as recited in claim 13 wherein said elastic frame comprises a Z-spring.

15. A damper assembly as recited in claim 13 wherein said legs stiffen said viscoelastic material.

16. A damper assembly as recited in claim 13 wherein said damper assembly is removable from said strut while maintaining the damping ability of said viscoelastic material.

17. A damper assembly as recited in claim 13 wherein said viscoelastic material extends beyond the outward facing surfaces of said legs.

18. A damper assembly as recited in claim 14 wherein said Z-spring includes a first end and a second end, said first end for insertion within said strut, said damper further comprising an installation finger extending from said second end.

19. A damper assembly as recited in claim 18 wherein said installation finger includes a tab to prevent overinsertion of the damper within said strut.

20. A damper assembly as recited in claim 19 wherein said viscoelastic material extends beyond the outward facing surfaces of said legs.

* * * * *